US010499464B2

(12) United States Patent
Cho et al.

(10) Patent No.: US 10,499,464 B2
(45) Date of Patent: Dec. 3, 2019

(54) COOKING APPLIANCE

(71) Applicants: GUANGDONG MIDEA KITCHEN APPLIANCES MANUFACTURING CO., LTD., Guangdong (CN); MIDEA GROUP CO., LTD., Guangdong (CN)

(72) Inventors: Jae man Cho, Guangdong (CN); Dong heon Lee, Guangdong (CN)

(73) Assignees: GUANGDONG MIDEA KITCHEN APPLIANCES MANUFACTURING CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 241 days.

(21) Appl. No.: 15/598,481

(22) Filed: May 18, 2017

(65) Prior Publication Data

US 2018/0249537 A1 Aug. 30, 2018

(30) Foreign Application Priority Data

Feb. 28, 2017 (CN) ..... 2017 1 0114719

(51) Int. Cl.
*H05B 6/64* (2006.01)

(52) U.S. Cl.
CPC ..... *H05B 6/642* (2013.01); *H05B 6/6402* (2013.01)

(58) Field of Classification Search
CPC ..... H05B 6/64; H05B 6/642; H05B 6/6402; H05B 6/6473; H05B 6/6494; H05B 6/6423

(Continued)

(56) References Cited

U.S. PATENT DOCUMENTS 3,829,649 A * 8/1974 Igarashi ..... H05B 6/642 219/710
4,369,347 A * 1/1983 Shin ..... H05B 6/642 126/21 R (Continued)

FOREIGN PATENT DOCUMENTS

CN 1512108 A 7/2004
CN 1606416 A 4/2005

(Continued)

OTHER PUBLICATIONS

First Office Action dated Aug. 2, 2019 received in Chinese Patent Application No. CN 201710114719.1 together with an English language translation.

(Continued)

*Primary Examiner* — Umashankar Venkatesan
(74) *Attorney, Agent, or Firm* — Scully Scott Murphy & Presser

(57) ABSTRACT

The present invention provides a cooking appliance, comprising a base and an oven door articulated with the base, wherein a first magnetron, a second magnetron, a first high voltage transformer and a second high voltage transformer are installed on the base; the cooking appliance further comprises an air-cooled radiator, which is installed on the base and provided with an air outlet; and cold air blown out of the air outlet flows through the first magnetron, the second magnetron, the first high voltage transformer and the second high voltage transformer. In this solution, the structure of a heat dissipation air duct system in the cooking appliance is changed, and only one air-cooled radiator is used for dissipating the heat of the two magnetrons and the two high voltage transformers, so that the quantity of heat dissipation fans in the product is reduced and the cost of the product can be reduced.

13 Claims, 3 Drawing Sheets

(58) Field of Classification Search
USPC ..... 219/680, 702, 757, 760, 761
See application file for complete search history.

(56) References Cited

U.S. PATENT DOCUMENTS

| | | | | | |
|---|---|---|---|---|---|
| 4,418,261 | A * | 11/1983 | Jailor | H05B 6/6423 126/21 A |
| 5,166,487 | A * | 11/1992 | Hurley | F24C 15/322 122/4 R |
| 5,483,044 | A * | 1/1996 | Thorneywork | H05B 6/645 126/21 A |
| 6,707,019 | B2 * | 3/2004 | Kim | H05B 6/6423 126/299 D |
| 8,759,728 | B2 * | 6/2014 | Tassan-Mangina | H05B 6/6482 219/680 |
| 10,104,722 | B2 * | 10/2018 | Ueki | F24C 15/006 |
| 2003/0121915 | A1 * | 7/2003 | Shon | F04D 29/384 219/757 |
| 2015/0305095 | A1 * | 10/2015 | Huang | H05B 6/6423 219/757 |
| 2018/0288834 | A1 * | 10/2018 | Li | H05B 6/64 |

FOREIGN PATENT DOCUMENTS

| | | | |
|---|---|---|---|
| CN | 201335431 | Y | 10/2009 |
| CN | 201555270 | U | 8/2010 |
| CN | 103615751 | A | 3/2014 |
| CN | 104633727 | A | 5/2015 |
| CN | 106322454 | A | 1/2017 |
| JP | S63-69192 | A | 3/1988 |

OTHER PUBLICATIONS

First Search dated Jul. 26, 2019 received in Chinese Patent Application No. CN 201710114719.1 together with an English language translation.

* cited by examiner

COOKING APPLIANCE

FIELD OF THE INVENTION

The present invention relates to the field of household appliances, and more particularly, relates to a cooking appliance.

BACKGROUND OF THE INVENTION

With the development of times, cooking appliances are increasingly diverse. At present, a novel barbecue type cooking appliance appears in the market, as shown in FIG. 1 and FIG. 2, the cooking appliance includes an oven door 2' and a base 1', the oven door 2' is articulated to the base 1' and can rotate up and down, an upper heating tube 3' is installed on the inner side the oven door 2', and a housing of the base 1' includes a front control panel 11' in the front, a bottom plate 12' at the bottom, outer covers 13' on left and right, a rear plate 14' on the back and a top plate at the top. The top plate is a cavity 15' having an opening upward, a lower heating tube 4' is installed inside the cavity 15', two waveguide tubes are welded to the bottom of the cavity 15', a magnetron 5' is arranged at the edge of each of the two waveguide tubes, and a high voltage transformer 6' is installed nearby the magnetrons 5'. In order to dissipate the heat of the magnetrons 5' and the high voltage transformer 6', the product needs three fans 7', the first fan 7' sucks air from air inlets of the left and right outer covers 13' and blows air to the right magnetron 5' to dissipate the heat of the right magnetron 5', and the air flowing through the right magnetron 5' is guided to the rear plate 14' via an exhaust air duct 9' and an exhaust tube 8' and discharged out of the product via an exhaust hole of the rear plate 14'. The second and third fans 7' are separately installed on the left and right of the high voltage transformer 6', wherein the second fan 7' sucks air from the air inlet of the adjacent outer cover 13' and blows air to the high voltage transformer 6' to dissipate the heat of the high voltage transformer 6', then the third fan 7' sucks the air flowing through the high voltage transformer 6' and blows air to the left magnetron 5' to dissipate the heat of the left magnetron 5', and finally, the air flowing through the left magnetron 5' is guided to the rear plate 14' via the exhaust air duct 9' and the exhaust tube 8' and discharged out of the product via the exhaust hole of the rear plate 14'. The heat dissipation air duct system needs three fans, so that many parts are needed, the cost is high, the assembly time of the product is long and the production efficiency is low.

SUMMARY OF THE INVENTION

The present invention intends to solve at least one of the technical problems in the prior art.

Thus, the object of the present invention is to provide a cooking appliance with a heat dissipation air duct system in low cost.

In order to fulfill the above object, the embodiment of the present invention provides a cooking appliance for baking the upper and lower surfaces of food and heating the interior of the food with microwave; the cooking appliance includes a base and an oven door articulated with the base, a sunken part is formed on the lower surface of the oven door and/or the upper surface of the base so that an accommodating cavity for accommodating the food is formed between the oven door and the base, the oven door can rotate up and down relative to the base to open or close the accommodating cavity, and an upper heating tube and a lower heating tube are respectively installed on the oven door and the base and located in the accommodating cavity; a first magnetron, a second magnetron, a first high voltage transformer and a second high voltage transformer are installed in the base; the first magnetron and the second magnetron are used for delivering microwave to the accommodating cavity; the cooking appliance further includes an air-cooled radiator, which is installed on the base and provided with an air outlet; and cold air blown out of the air outlet flows through the first magnetron, the second magnetron, the first high voltage transformer and the second high voltage transformer.

The cooking appliance provided by this solution can bake the upper and lower surfaces of food and simultaneously heat the interior of the food with microwave, so that the interior and exterior of the food are heated uniformly to avoid the problem that the outer surface is burnt but the interior is under-heated or under-cooked when food such as sandwich and the like. In this solution, the structure of the heat dissipation air duct system in the cooking appliance is changed, and only one air-cooled radiator is used for dissipating the heat of the two magnetrons and the two high voltage transformers, so that the quantity of heat dissipation fans in the product is reduced and the cost of the product can be reduced. Besides, after the quantity of the heat dissipation fans is reduced, the assembly operation of the product becomes simple, the assembly time is correspondingly shortened, the production and assembly efficiency of the product can be improved, and the input of labor cost is reduced, so that the production cost of the product is further reduced and the market competitiveness of the product is improved.

In the above technical solution, preferably, the first high voltage transformer is arranged close to the first magnetron, the second high voltage transformer is arranged close to the second magnetron, the air outlet includes a first sub air outlet and a second sub air outlet, one part of cold air blown out of the first sub air outlet flows through the first magnetron and the other part flows through the first high voltage transformer, one part of cold air blown out of the second sub air outlet flows through the second magnetron and the other part flows through the second high voltage transformer.

In this solution, the first high voltage transformer is arranged close to the first magnetron, the second high voltage transformer is arranged close to the second magnetron, and such design enables the installation structure of parts inside the product to be compact and reduces the occupied installation space, thereby reducing the size of the product.

Moreover, in the existing product, the heat of one of the two magnetrons is dissipated by air flowing through the high voltage transformer, and the temperature after the air flows through the high voltage transformer is relatively high, so that the heat dissipation effect of the magnetron is poor. In this solution, the heat of the two magnetrons and the two high voltage transformers is directly dissipated by cold air blown out of the air outlet of the air-cooled radiator, and such design ensures that the heat dissipation air duct system can achieve a good heat dissipation effect on each magnetron and each high voltage transformer.

In any of the above technical solutions, preferably, the air-cooled radiator includes a first fan blade, a second fan blade and a motor, a motor shaft of the motor is connected with the first fan blade and the second fan blade and used for driving the first fan blade and the second fan blade to rotate, the first fan blade is used for blowing air to the first magnetron and the first high voltage transformer, and the second fan blade is used for blowing air to the second magnetron and the second high voltage transformer.

The air-cooled radiator drives two fan blades via one motor, the structure of the radiator is simple, and only one motor is used, so that the manufacturing cost of the air-cooled radiator is low and the production cost of the product can be reduced in such design.

In any of the above technical solutions, preferably, the air-cooled radiator further includes a casing, the first fan blade, the second fan blade and the motor are installed in the casing, and the casing is provided with an air inlet and the air outlet.

In any of the above technical solutions, preferably, the base includes an enclosure, which includes a front control panel, a bottom plate, a rear plate, a top plate, a left outer cover and a right outer cover; the first magnetron, the second magnetron, the first high voltage transformer, the second high voltage transformer and the air-cooled radiator are installed in the enclosure.

In any of the above technical solutions, preferably, a fixed support is installed on the bottom plate, and the first high voltage transformer and the second high voltage transformer are installed on the fixed support.

In the existing product, the high voltage transformer is directly installed on the bottom plate of the base, and if the product drops, the high voltage transformer would produce great impact on the bottom plate, causing deformation of the bottom plate. In this solution, a fixed support is added to the base, and the two high voltage transformers are installed on the fixed support, thereby avoiding the problem that the high voltage transformers directly impact the bottom plate during dropping to cause deformation of the bottom plate, to improve the quality of the product.

In any of the above technical solutions, preferably, the left outer cover and the right outer cover are respectively provided with an air inlet, and the rear plate is provided with an exhaust hole.

In any of the above technical solutions, preferably, the first magnetron and the second magnetron are arranged side by side on left and right, and installed close to the center of the enclosure.

In such design, the installation structure of parts inside the product is compact, and the occupied installation space is small, so that the size of the product can be reduced.

In any of the above technical solutions, preferably, the air-cooled radiator is installed on one side of the first magnetron and the second magnetron away from the rear plate, a first exhaust tube is arranged between the first magnetron and the exhaust hole, and a second exhaust tube is arranged between the second magnetron and the exhaust hole.

In this solution, the two exhaust tubes guide hot air flowing through the two magnetrons to the exhaust hole of the rear plate to discharge, and such design improves the discharge effect of the hot air in the base and is beneficial to reducing the temperature inside the base, thereby improving the heat dissipation effect of the high voltage transformers and the magnetrons, and avoiding the problem of product failure caused by too high temperature inside the base.

In any of the above technical solutions, preferably, the top plate is a cavity having an opening upward, the first magnetron is connected with the cavity via a first waveguide tube, and the second magnetron is connected with the cavity via a second waveguide tube.

The additional aspects and advantages of the preset invention will be obvious in the following description or be understood by practice of the present invention.

BRIEF DESCRIPTION OF THE DRAWINGS

The above-mentioned and/or additional aspects and advantages of the preset invention will be obvious and easily understood from the description of embodiments in combination with the following drawings, in which:

Wherein, the black thick arrows in FIG. 2 represent air flow directions, and the corresponding relation between reference signs and part names in FIG. 1 and FIG. 2 is as follows:

1' base, 11' front control panel, 12' bottom plate, 13' outer cover, 14' rear plate, 15' cavity, 2' oven door, 3' upper heating tube, 4' lower heating tube, 5' magnetron, 6' high voltage transformer, 7' fan, 8' exhaust tube, 9' exhaust air duct.

Figure 1:
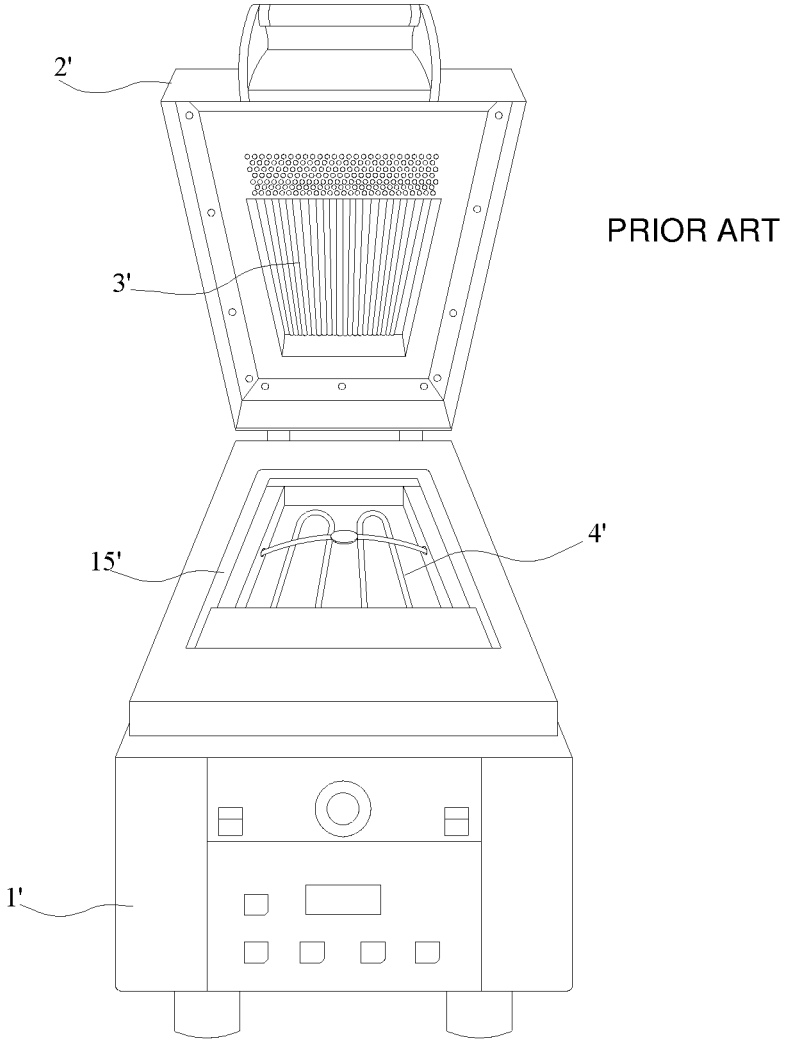
FIG. 1 is a structural schematic diagram of a cooking appliance in the prior art.
Figure 2:
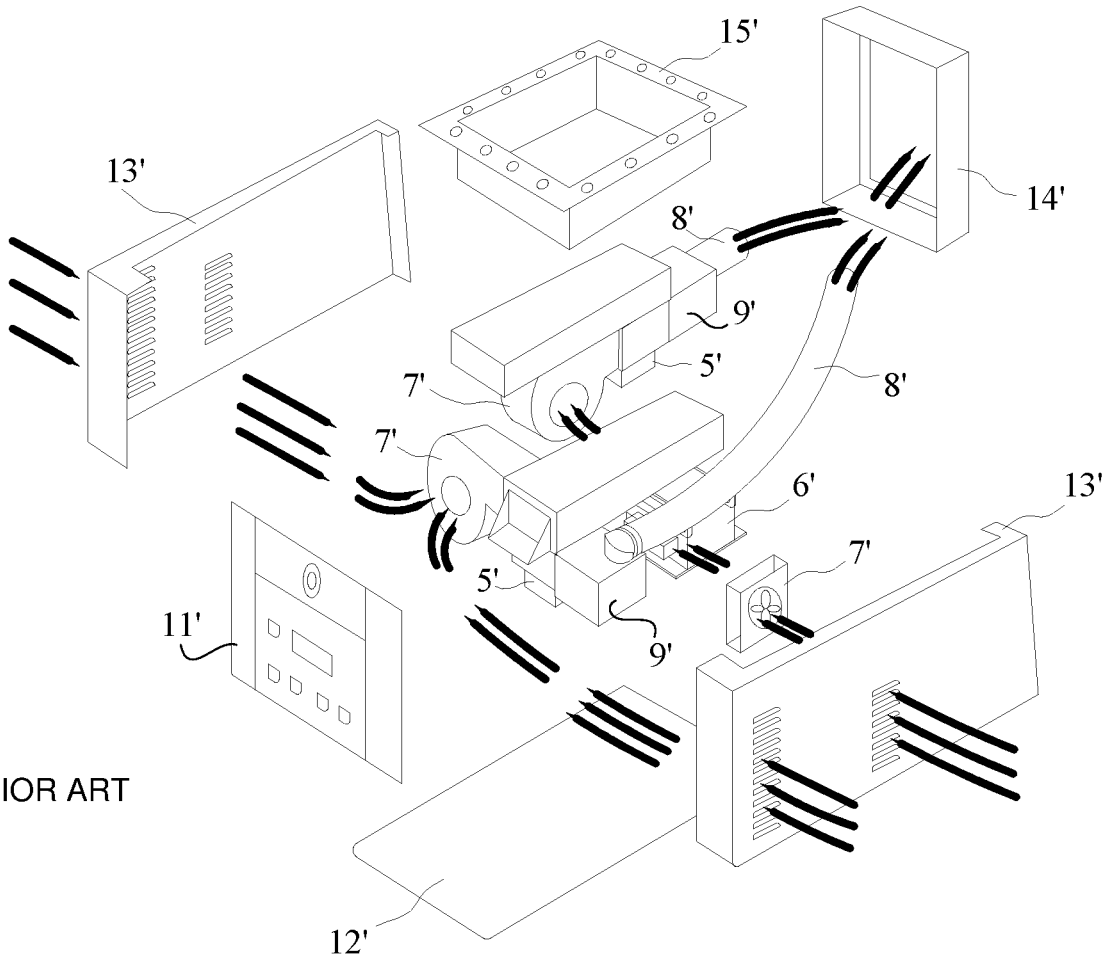
FIG. 2 is an exploded view of a base shown in FIG. 1.
Figure 3:
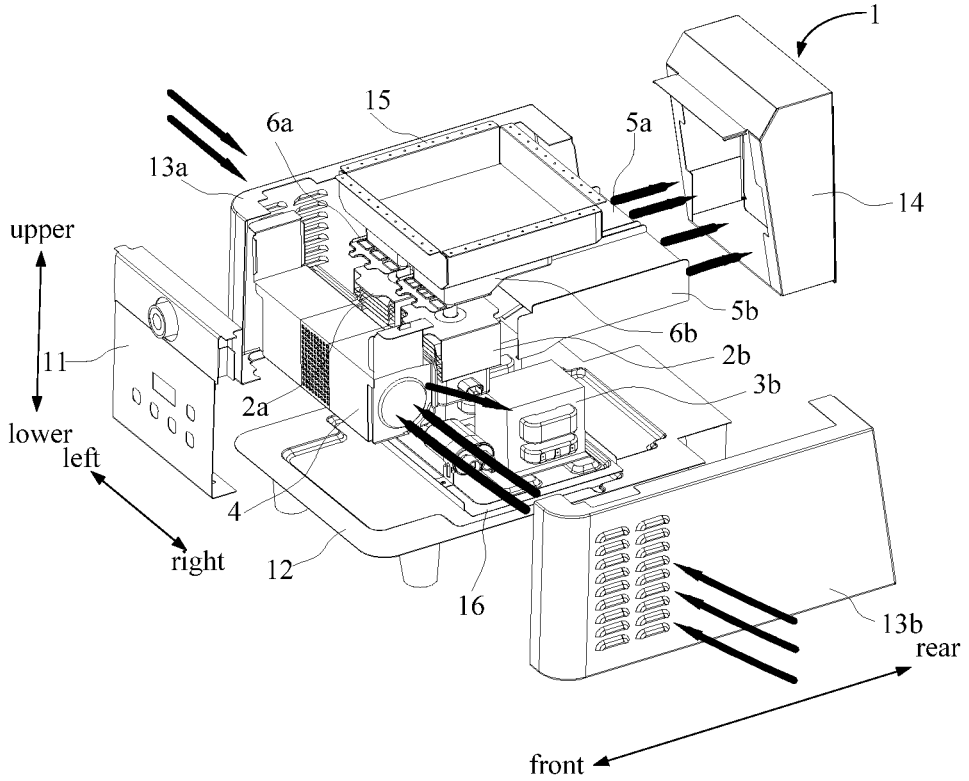
Figure 4:
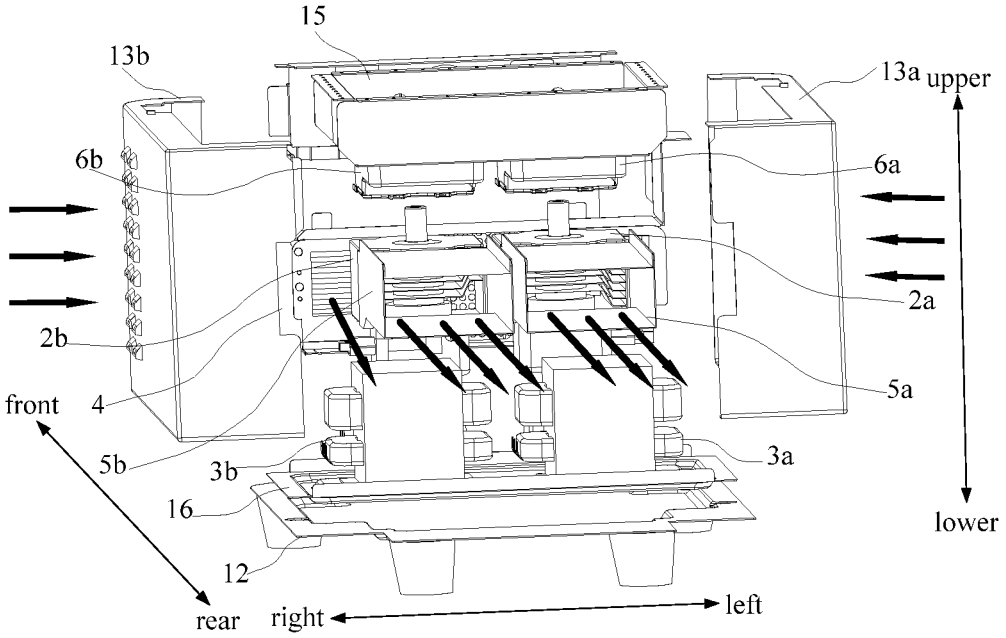

FIG. 3 is an exploded view of a base of a cooking appliance provided by one embodiment of the present invention;

FIG. 4 is a structural schematic diagram of the base shown in FIG. 3 at another angle.

Wherein, the black thick arrows in FIG. 3 and FIG. 4 represent air flow directions, and the corresponding relation between reference signs 4 and part names in FIG. 3 and Fig. is as follows:

1 base, 11 front control panel, 12 bottom plate, 13*a* left outer cover, 13*b* right outer cover, 14 rear plate, 15 cavity, 16 fixed support, 2*a* first magnetron, 2*b* second magnetron, 3*a* first high voltage transformer, 3*b* second high voltage transformer, 4 air-cooled radiator, 5*a* first exhaust tube, 5*b* second exhaust tube, 6*a* first waveguide tube, 6*b* second waveguide tube.

DETAILED DESCRIPTION OF THE EMBODIMENTS

In order to more clearly understand the above-mentioned objects, features and advantages of the present invention, the present invention will be further described in detail below in combination with the accompanying drawings and specific embodiments. It should be noted that the embodiments of the present application and the features in the embodiments can be combined with each other without conflicts.

In the following description, numerous specific details are set forth in order to fully understand the present invention. However, the present invention can also be implemented in other ways different from that described herein. Therefore, the protection scope of the present invention is not limited to the specific embodiments disclosed below.

This solution is directed to a novel cooking appliance, which can bake the upper and lower surfaces of food and simultaneously heat the interior of the food with microwave, so that the interior and exterior of the food are heated uniformly, and the problem that the outer surface is burnt but the interior is under-heated or under-cooked when food such as sandwich and the like is heated is avoided. The structure of the heat dissipation air duct system in the cooking appliance provided by the present invention is changed, and only one air-cooled radiator is used for dissipating the heat of two magnetrons and two high voltage transformers, so that the quantity of heat dissipation fans in the product is reduced and the cost of the product can be reduced. Besides, after the quantity of the heat dissipation fans is reduced, the assembly operation of the product becomes simple, the assembly time is correspondingly shortened, the production and assembly efficiency of the product can be improved, and the input of labor cost is reduced, so that the production cost of the product is further reduced and the market competitiveness of the product is improved.

As shown in FIG. 3 and FIG. 4, according to one embodiment of the present invention, the cooking appliance includes an oven door and a base 1, the oven door is articulated to the base 1 and can rotate up and down, an upper heating tube is installed on the inner side of the oven door, and an enclosure of the base 1 includes a front control panel 11 in the front, a bottom plate 12 at the bottom, a rear plate 14 on the back, a top plate at the top as well as a left outer cover 13*a* and a right outer cover 13*b* on the left and right sides. The top plate is a cavity 15 having an opening upward, a lower heating tube is installed at the bottom of the cavity 15, and a bearing plate for bearing food is installed above the lower heating tube to prevent food from being burnt by direct contact with the lower heating tube. A first magnetron 2*a*, a second magnetron 2*b*, a first high voltage transformer 3*a*, a second high voltage transformer 3*b* and an air-cooled radiator are installed in the enclosure, the air-cooled radiator is provided with an air outlet, and cold air blown out of the air outlet flows through the first magnetron 2*a*, the second magnetron 2*b*, the first high voltage transformer 3*a* and the second high voltage transformer 3*b* to dissipate the heat of the two magnetrons and the two high voltage transformers.

In the above embodiment, preferably, the first high voltage transformer 3*a* is arranged close to the first magnetron 2*a*, the second high voltage transformer 3*b* is arranged close to the second magnetron 2*b*, the air outlet includes a first sub air outlet and a second sub air outlet, one part of cold air blown out of the first sub air outlet flows through the first magnetron 2*a* and the other part flows through the first high voltage transformer 3*a*, one part of cold air blown out of the second sub air outlet flows through the second magnetron 2*b* and the other part flows through the second high voltage transformer 3*b*.

In this solution, the first high voltage transformer 3*a* is arranged close to the first magnetron 2*a*, the second high voltage transformer 3*b* is arranged close to the second magnetron 2*b*, and such design enables the installation structure of parts inside the product to be compact and reduces the occupied installation space, thereby reducing the size of the product.

Moreover, in the existing product, the heat of one of the two magnetrons is dissipated by air flowing through the high voltage transformer, and the temperature after the air flows through the high voltage transformer is relatively high, so that the heat dissipation effect of the magnetron is poor. In this solution, the heat of the two magnetrons and the two high voltage transformers is directly dissipated by cold air blown out of the air outlet of the air-cooled radiator, and such design ensures that the heat dissipation air duct system can achieve a good heat dissipation effect on each magnetron and each high voltage transformer.

In any of the above embodiments, preferably, the air-cooled radiator includes a first fan blade, a second fan blade and a motor, a motor shaft of the motor is connected with the first fan blade and the second fan blade and used for driving the first fan blade and the second fan blade to rotate, the first fan blade is used for blowing air to the first magnetron 2*a* and the first high voltage transformer 3*a*, and the second fan blade is used for blowing air to the second magnetron 2*b* and the second high voltage transformer 3*b*.

The air-cooled radiator drives two fan blades via one motor, the structure of the radiator is simple, and only one motor is used, so that the manufacturing cost of the air-cooled radiator is low and the production cost of the product can be reduced in such design.

In any of the above embodiments, preferably, a fixed support 16 is installed on the bottom plate 12, and the first high voltage transformer 3*a* and the second high voltage transformer 3*b* are installed on the fixed support 16.

In the existing product, the high voltage transformer is directly installed on the bottom plate of the base, and if the product drops, the high voltage transformer produces great impact on the bottom plate, causing deformation of the bottom plate. In this solution, a fixed support 16 is added to the base 1, and the two high voltage transformers are installed on the fixed support 16, thereby avoiding the problem that the high voltage transformers directly impact the bottom plate 12 during dropping to cause deformation of the bottom plate 12, to improve the quality of the product.

In any of the above embodiments, preferably, the left outer cover 13*a* and the right outer cover 13*b* are respectively provided with an air inlet, and the rear plate 14 is provided with an exhaust hole.

In any of the above embodiments, preferably, the first magnetron 2*a* and the second magnetron 2*b* are arranged side by side on left and right, and installed close to the center of the enclosure. The first magnetron 2*a* is connected with the cavity 15 via a first waveguide tube 6*a*, and the second magnetron 2*b* is connected with the cavity 15 via a second waveguide tube 6*b*.

In such design, the installation structure of parts inside the product is compact, and the occupied installation space is small, so that the size of the product can be reduced.

In any of the above embodiments, preferably, the air-cooled radiator is installed on one side of the first magnetron 2*a* and the second magnetron 2*b* away from the rear plate 14, a first exhaust tube 5*a* is arranged between the first magnetron 2*a* and the exhaust hole, and a second exhaust tube 5*b* is arranged between the second magnetron 2*b* and the exhaust hole.

In this solution, the two exhaust tubes guide hot air flowing through the two magnetrons to the exhaust hole of the rear plate 14 to discharge, and such design improves the discharge effect of the hot air in the base 1 and is beneficial to reducing the temperature inside the base 1, thereby improving the heat dissipation effect of the high voltage transformers and the magnetrons, and avoiding the problem of product failure caused by too high temperature inside the base.

In the description of the specification, it should be understood that the orientation or position relations indicated by terms "upper", "lower", "front", "rear", "left", "right", "top", "bottom", "inner" and "outer" are based on those shown in the accompanying drawings, are only used for facilitating the description of the present invention and simplifying the description, instead of indicating or implying that the indicated devices or elements must have specific orientations and be constructed and operated in the specific orientations, and thus cannot be understood as limiting the present invention.

In the description of the specification, the descriptions of the terms "one embodiment", "some embodiments", "specific embodiment" and the like mean that features, structures, materials or characteristics described in combination with the embodiments or examples are included in the at least one embodiment or example of the present invention. In the specification, the schematic expression of the terms may not indicate the same embodiments or examples. Besides, the described specific features, structures, materials or characteristics can be combined appropriately in any one or more embodiments or examples.

In the description of the present invention, the terms "first" and "second" are merely used for the purpose of description, but cannot be understood as indicating or implying relative importance, unless otherwise specified and defined; the terms "connected", "installed", "fixed" and the like should be broadly understood, e.g., "connected" may be fixedly connected, detachably connected, integrally connected, directly connected, or indirectly connected via an intermediary. Those of ordinary skill in the art can understand the specific meanings of the terms in the present invention according to specific circumstances.

Described above are merely preferred embodiments of the present invention, which are not used for limiting the present invention. Various modifications and changes can be made to the present invention for those skilled in the art. Any modification, equivalent substitution, improvement and the like made within the spirit and principle of the present invention shall fall into the protection scope of the present invention.

The invention claimed is:

1. A cooking appliance comprising:

a base;

an oven door configured to articulate relative to the base between a first position that is closer to the base and a second position that is further from the base, wherein an upper surface of the base, a lower surface of the oven door or both are configured to, in the first position, define an accommodating cavity for accommodating food;

an upper heating tube installed in the oven door and a lower heating tube installed in the base, wherein the upper heating tube and the lower heating tube are configured to generate heat for heating the accommodating cavity;

a first magnetron, a second magnetron, a first high voltage transformer and a second high voltage transformer installed in the base and configured to deliver microwave to the accommodating cavity; and an air-cooled radiator installed in the base, wherein the air-cooled radiator defines a first air outlet and a second air outlet, wherein the first magnetron is arranged close to the first high voltage transformer such that one part of air blown out of the first air outlet flows through the first magnetron, and another part of the air blown out of the first air outlet flows through the first high voltage transformer, and wherein the second magnetron is arranged close to the second high voltage transformer such that one part of air blown out of the second air outlet flows through the second magnetron and another part of the air blown out of the second air outlet flows through the second high voltage transformer.

2. The cooking appliance of claim 1, wherein the air-cooled radiator comprises a first fan blade, a second fan blade and a motor, wherein a motor shaft of the motor is connected with the first fan blade and the second fan blade, wherein the motor is configured to drive, through the motor shaft, the first fan blade and the second fan blade to rotate, wherein the first fan blade is configured to blow air, through the first air outlet, to the first magnetron and the first high voltage transformer, and wherein the second fan blade is configured to blow air, through the second air outlet, to the second magnetron and the second high voltage transformer.

3. The cooking appliance of claim 2, wherein the air-cooled radiator further comprises a casing, and wherein the first fan blade, the second fan blade and the motor are installed in the casing, and the casing defines an air inlet, the first air outlet and the second air outlet.

4. The cooking appliance of claim 2, wherein the base comprises a front control panel, a bottom plate, a rear plate, a top plate, a left outer cover and a right outer cover, wherein the front control panel, the bottom plate, the rear plate, the top plate, the left outer cover and the right outer cover define an enclosure, and wherein the first magnetron, the second magnetron, the first high voltage transformer, the second high voltage transformer and the air-cooled radiator are installed in the enclosure.

5. The cooking appliance of claim 4, further comprising a fixed support installed on the bottom plate, wherein the first high voltage transformer and the second high voltage transformer are installed on the fixed support.

6. The cooking appliance of claim 4, wherein the left outer cover defines a first air inlet, wherein the right outer cover defines a second air inlet, and wherein the rear plate defines an exhaust hole.

7. The cooking appliance of claim 4, wherein the first magnetron and the second magnetron are arranged side by side on a left side and a right side of the enclosure.

8. The cooking appliance of claim 6, wherein the air-cooled radiator is installed on one side of the first magnetron and the second magnetron away from the rear plate, and wherein the cooking appliance further comprises:

a first exhaust tube arranged between the first magnetron and the exhaust hole; and a second exhaust tube arranged between the second magnetron and the exhaust hole.

9. The cooking appliance of claim 4, wherein the top plate defines a cavity having an opening upward, and wherein the cooking appliance further comprises:

a first waveguide tube configured to connect the first magnetron with the cavity; and a second waveguide tube configured to connect the second magnetron with the cavity.

10. The cooking appliance of claim 5, wherein the top plate defines a cavity having an opening upward, and wherein the cooking appliance further comprises:

a first waveguide tube configured to connect the first magnetron with the cavity;

a second waveguide tube configured to connect the second magnetron with the cavity.

11. The cooking appliance of claim 6, wherein the top plate defines a cavity having an opening upward, and wherein the cooking appliance further comprises:

a first waveguide tube configured to connect the first magnetron with the cavity; and a second waveguide tube configured to connect the second magnetron with the cavity.

12. The cooking appliance of claim 7, wherein the top plate defines a cavity having an opening upward, and wherein the cooking appliance further comprises:

a first waveguide tube configured to connect the first magnetron with the cavity; and a second waveguide tube configured to connect the second magnetron with the cavity.

13. The cooking appliance of claim 8, wherein the top plate defines a cavity having an opening upward, and wherein the cooking appliance further comprises:

a first waveguide tube configured to connect the first magnetron with the cavity; and a second waveguide tube configured to connect the second magnetron with the cavity.

* * * * *